US010920350B2

(12) United States Patent
Schreyeck et al.

(10) Patent No.: US 10,920,350 B2
(45) Date of Patent: Feb. 16, 2021

(54) FELTING NEEDLE AND METHOD FOR PRODUCING AT LEAST ONE FELTING NEEDLE

(71) Applicant: Groz-Beckert KG, Albstadt (DE)

(72) Inventors: Jörg Schreyeck, Straßberg (DE); Christian Weber, Albstadt (DE); Gustav Wizemann, Meßstetten (DE); Roland Schick, Albstadt (DE); Jürgen Weith, Burladingen-Hausen (DE)

(73) Assignee: Groz-Beckert KG, Albstadt (DE)

( * ) Notice: Subject to any disclaimer, the term of this patent is extended or adjusted under 35 U.S.C. 154(b) by 27 days.

(21) Appl. No.: 16/315,459

(22) PCT Filed: Jun. 28, 2017

(86) PCT No.: PCT/EP2017/065963
§ 371 (c)(1),
(2) Date: Jan. 4, 2019

(87) PCT Pub. No.: WO2018/007221
PCT Pub. Date: Jan. 11, 2018

(65) Prior Publication Data

US 2019/0301066 A1 Oct. 3, 2019

(30) Foreign Application Priority Data

Jul. 5, 2016 (EP) ..... 16177989

(51) Int. Cl.
*D04H 18/02* (2012.01)
*D04H 18/00* (2012.01)

(52) U.S. Cl.
CPC ..... *D04H 18/02* (2013.01); *D04H 18/00* (2013.01)

(58) Field of Classification Search
CPC . D04H 8/02; D04H 18/00; D04B 3/02; D04B 33/00; B21G 1/06; B21G 1/00; B21G 1/003
(Continued)

(56) References Cited

U.S. PATENT DOCUMENTS 2,495,926 A 1/1950 Foster
2,678,484 A 5/1954 Brown
(Continued)

OTHER PUBLICATIONS

International Search Report dated Aug. 16, 2017 for corresponding Application No. PCT/EP2017/065963 (14 pages).
(Continued)

*Primary Examiner* — Amy Vanatta
(74) *Attorney, Agent, or Firm* — Fitch, Even, Tabin & Flannery LLP

(57) ABSTRACT

A felting needle has a working part that extends lengthwise along a part of the longitudinal extent thereof. The needle has a cross-sectional area which extends in the radial and circumferential directions of the felting needle and forms the cross-sectional area of the working part for much of the length thereof and at least one barb which penetrates into the working part which is formed by an incut running from the outer surface of the working part towards the interior of the needle. The needle includes at least one bulge which projects beyond the circumferential surface of the felting needle in the working part thereof. The bulge extends lengthwise only along a part of the working part and has volume constituents that do not belong to the barbing bead of the barb. The barb adjoins the outer surface of the bulge lengthwise along the felting needle.

14 Claims, 10 Drawing Sheets

(58) Field of Classification Search
USPC ..... 28/115; 163/5, 1
See application file for complete search history.

(56) References Cited

U.S. PATENT DOCUMENTS 2,696,035 A * 12/1954 Foster ..... D04H 18/00 28/115
3,224,067 A 12/1965 Foster
3,307,238 A * 3/1967 Foster ..... D04H 18/02 28/115
3,390,440 A * 7/1968 Foster ..... D04H 18/00 28/115
3,464,097 A * 9/1969 Zocher ..... D04H 18/02 28/115
3,641,636 A * 2/1972 Foster ..... D04H 18/00 28/115
3,762,004 A * 10/1973 Shepard ..... D04H 18/00 28/115
3,913,189 A * 10/1975 Foster ..... D04H 18/00 28/115
3,983,611 A 10/1976 Zocher
4,030,170 A * 6/1977 Eckhardt ..... D04H 18/02 28/115
4,156,305 A * 5/1979 Foster ..... B21G 1/06 28/115

OTHER PUBLICATIONS

Written Decision of the International Preliminary Examining Authority dated Jun. 26, 2018 for corresponding Application No. PCT/EP2017/065963 (7 pages).
Extended European Search Report dated Dec. 5, 2016 for corresponding Application No. 16177989.7 (7 pages).
International Preliminary Report on Patentability dated Sep. 25, 2018 for corresponding Application No. PCT/EP2017/065963, with English Translation (41 pages).
European Communication pursuant to Article 94(3) dated Mar. 22, 2019, in corresponding European Application No. 16177989.7, with machine English translation (10 pgs.).
European Communication pursuant to Article 94(3) dated Mar. 26, 2020, in corresponding European Application No. 16177989.7, with machine English translation (8 pgs.).

* cited by examiner

FELTING NEEDLE AND METHOD FOR PRODUCING AT LEAST ONE FELTING NEEDLE

CROSS REFERENCE TO RELATED APPLICATIONS

This patent application is the national phase of PCT/EP2017/065963, filed Jun. 28, 2017, which claims the benefit of European Patent Application 16177989.7, filed Jul. 5, 2016. Each of the foregoing applications are incorporated by reference in their entirety.

TECHNICAL FIELD

Felting needles and methods for the production thereof are known. Felting needles are used to change the density of randomly oriented fibres. In most cases, the fibres are compacted to form felted fabrics. For this purpose, felting needles are suspended by way of a mounting (often termed "foot" and frequently consisting of a bent part of the needle shank) from a needle board. Except for their foot, felting needles are often elongate needles that often end in a point at their working end (the end of the needle closer to the fibres).

BACKGROUND

Part of the needle's aforementioned length is taken up by the working part, adjoined frequently by the point of the needle. As a rule, this working part has a specially formed cross-sectional area (very often, polygonal shapes such as triangles or squares are used). However, round shapes—such as teardrops—are also known for these cross-sectional areas. The working part has barbs which run from the outside profile of the cross-sectional area of the working part towards the interior thereof. These barbs are often made by a cutting action known as barbing. The barbing of felting needles is described, among other publications, in U.S. Pat. Nos. 3,224,067 B and 2,495,926 B. It is evident particularly from the drawings of these publications that the barbing process also produces barbing beads, which are important for the barbs' mode of operation outlined below. The aforementioned barbs hold the textile fibres during a working cycle of the needle board, which consists in a movement of the needle board relative to the textile fibres. The barbs are accordingly of major importance during felting. The barbing beads enhance the aforementioned holding function of the barbs.

The needle boards perform a large number of working cycles per time unit during felting. It is accordingly not surprising that felting needles are exposed to a high load, in particular as a result of their contact with the textile fibres. Increasing the durability or service life of felting needles is accordingly one of the subjects which professional circles have already been working on for a lengthy period of time. To solve this problem, the publication U.S. Pat. No. 2,678,484 B suggests providing felting needles, which have a plurality of successive barbs lengthwise of the needle, with a leading barb which is located closest to the needle point, is less pronounced and also has a less pronounced barbing bead than the barbs spaced further away from the point. The already mentioned publication U.S. Pat. No. 2,495,926 B attempts to solve the problem in a different way: thanks to a specially shaped barbing tool, the barbing bead is broader and is accordingly able to withstand the continuous friction of the textile fibres for a longer period of time.

The technical teaching of the publication U.S. Pat. No. 3,224,067 B, which has also already been mentioned, is based on a different problem: in order to enable efficient and damage-free needling of fine textiles, the width of the barbs and their barbing beads is adjusted by providing the cross-sectional profile of the needle's working parts with ridges that extend along the entire length of the working part.

The ridges or edges of the aforementioned publication are produced by swaging. Barbs are subsequently struck into these ridges such that the barbs and their beads have the width of the ridges in the needle's circumferential direction. It is unlikely that the service life of the barbs and their beads can be increased in the described manner because of their very exposed position on the filigree ridges.

SUMMARY

The objective of this invention is to increase the service life of felting needles. The present invention is based on the last-mentioned publication and achieves the objective by combining the features described herein.

As already mentioned, most felting needles have a working part with a cross-sectional area which extends in the radial (r) and circumferential direction ((p) of the felting needle and is bounded over much of the length of the working part by a cross-sectional profile. In this context, "much of the length of the working part" generally means that the working part deviates only in the areas bordering on the shank of the needle and/or on the working-end extremity of the needle (as a rule, the point) and in the area of barbs and barbing beads. This is advantageous because the working part of the felting needles is intended to dip into the fibres, the barbs, in particular, and maybe the barbing beads, being intended to engage the fibres. Accordingly, it is mainly or exclusively the barbs and maybe the barbing beads that penetrate into or deviate from the cross-sectional profile of the working part.

In the working part, at least one barb penetrates into the cross-sectional profile. The barb in this context is formed by an incut running from the cross-sectional profile towards the interior of the felting needle or towards the axis of the needle. One might also say that, as a rule, felting-needle barbs run in radial and axial direction from the outer contour of the cross-sectional profile towards the interior and maybe the symmetry axis of the felting needles.

As also already mentioned, most felting needles have barbing beads in the area of the barbs, which were formed by material displacement during barbing. These barbing beads project beyond the aforementioned contour in the needle's radial direction. Accordingly, they contribute substantially to felting.

Conventional felting needles, which, as a rule, have the aforementioned features, are refined according to the present invention by the following features:

- at least one bulge, which projects beyond the circumferential surface of the felting needle in the working part thereof in the needle's radial direction (r),
- wherein the bulge extends, lengthwise (z) of the felting needle, only along a part of the extent of the working part in said direction (z),
- wherein the bulge has volume constituents that do not belong to the barbing bead of the barb
- and wherein the barb adjoins the outer surface of the bulge lengthwise of the felting needle.

The at least one bulge may be provided during production of the working part. It may, however, also be created advantageously by means of a successive production process. The bulge only projects radially beyond the cross-sectional profile in a part of the extent of the working part in the longitudinal direction of the felting needle. The bulge is accordingly not a part of the cross-sectional profile that is constant over a large part of the working part or even over the entire working part. The bulge is, furthermore, not an edge or a ridge in the sense of the U.S. Pat. No. 3,224,067 B, as these components of the needle also run along the entire working part.

The bulge has at least volume constituents that do not belong to the barbing bead, i.e. were not created as a result of volume displacement during the barbing process. As a rule, however, the bulge is reinforced by the barbing bead, which is advantageous.

It is particularly advantageous if the barb adjoins the outer surface of the bulge lengthwise of the felting needle. The barb can do this if it is located in front of or behind the bulge as seen in the forward direction of the needle during felting. If the bulge is produced before the barb, it is advantageous to strike the barb either directly in front of the commencement of the bulge or even into the barb in such a way that the barb again directly adjoins the (maybe new) outer surface of the bulge but that no left-over part of the bulge remains on the other side of the barb. One might also say that the barb may penetrate advantageously into the original outer surface of the bulge. It is also possible to have a small gap between the barb and the bulge (examples: less than the length of the barb in the needle's longitudinal direction (z), preferably less than half the length of the barb in this direction (z), or, for an even greater advantage, less than a quarter of the length of the barb opening in the needle's longitudinal direction). It is advantageous for the barb and the bulge to have the same position in the circumferential direction and/or to be located on an edge.

The already mentioned radial direction (r) of the needle is often called the "elevational direction". It is to advantage if the height of the at least one bulge varies lengthwise of the needle. It is advantageous, for example, if, in the plane defined by the longitudinal extent and the radial direction of the needle, the bulge has a convex profile (as seen from the needle's symmetry axis). An angular profile may also have advantages. In both cases, it is advantageous if the height of the bulge has localized maxima. It is advantageous if the bulge has its maximum height at a distance from the barb's inflection point which is at least 25% or, even better, at least 30% of the entire longitudinal extent of the bulge. It is of advantage to produce the bulge by means of a non-machining process—for example a swaging process—or to produce the bulge at least partly by means of such a process. It is expedient in this context if the dies, or at least one die, is moved predominantly in the circumferential direction and/or the radial direction of the needle. However, the at least one bulge may also be created during the forming process by which the cross-sectional profile of the working part is produced, or even during production of the blank.

It is advantageous if at least parts of the bulge taper as the height of the bulge (=radial distance from the needle's axis) increases. Depending on the type of application of the felting needles, it will prove advantageous if the first barb is located on that side of a first bulge that is nearer, lengthwise of the needle, to the needle point. However, there are also needles—so-called reverse-barb needles or U-needles—where the barbs are advantageously located on the side further away, lengthwise (z) of the needle, from the needle point.

It is of advantage if, in this direction (direction of the first barb as viewed from the first bulge), no further bulge is located lengthwise of the needle over a given distance (measured, for example, from the lip of the barb). This applies particularly to bulges that overlap in the circumferential direction ((p) with the barb.

Examples of advantageous minimum distances such as these are:

a) at least a distance that corresponds with the length of the barb opening lengthwise of the felting needle,
b) advantageously, however, a distance that is twice the length of the barb opening lengthwise of the felting needle,
c) advantageously, however, a distance that is four times the length of the barb opening lengthwise of the felting needle,
d) if no further bulge at all that overlaps in the circumferential direction with the first barb is located lengthwise (z) of the felting needle.

It is advantageous if the bulge already exists (for example, already in the needle blank) or is formed prior to striking of the barb. It is of further advantage to position the barb such that, during striking of the barb, the barbing tool also displaces some of the bulge, thereby increasing the size of the bulge in the radial and/or circumferential direction(s) of the needle (a barbing bead is again formed in the area of the bulge and reinforces it). This effect may be achieved by applying the tool in the immediate vicinity of the bulge or even in contact therewith.

It is of advantage if the at least one bulge is located at a point on the needle's surface at which the boundary of the cross-sectional profile of the working part is especially far from the needle's axis. This is the case in the area of edges or corners. If this design principle is adhered to, the at least one bulge will project beyond the already exposed edge or the exposed corner in such a way as to make very intense contact with the fibres during felting.

If and in so far as the bulge is a swaged bulge, it is advantageous to create it using at least two pressing tools. These two pressing tools act, at least predominantly, in the needle's circumferential direction. As a rule, however, the direction of action will also contain components in the needle's radial direction. The two pressing tools act in opposite directions and can be moved by the same amount or by different amounts. It is also possible in this context for one tool simply to act as a stop while the other(s) is/are moved.

It is advantageous if the bulge is provided with a clearly defined bounding surface in the needle's radial direction. This shaping of the bounding surface in the needle's radial direction may extend to a defined height setting for the bulge. This measure is accordingly advantageous for all embodiments of the needles disclosed and claimed in this publication. Shaping may be performed with a die which acts at least predominantly in the needle's radial direction. A die which acts at least predominantly in the radial direction has a working surface which acts predominantly in the radial direction. The die may be moved predominantly in the radial direction. However, it may also serve as a stop that prevents further radial growth of the bulge. Example: a radially acting stop of this kind prevents further growth of the bulge due to a swaging process in which the pressing tools act predominantly in the circumferential direction and thus displace the material of the bulge in the radial direction. In this case, the radially acting die serves as a stop for the displaced material of the bulge. The radially acting stop or die may also be structurally connected with at least one of the pressing tools (possibly even integrally) that act predominantly in the needle's radial direction and are able to create the bulge if this is a swaged bulge.

BRIEF DESCRIPTION OF THE DRAWINGS

The following drawings show further embodiments of the invention.

DETAILED DESCRIPTION

Figure 1:
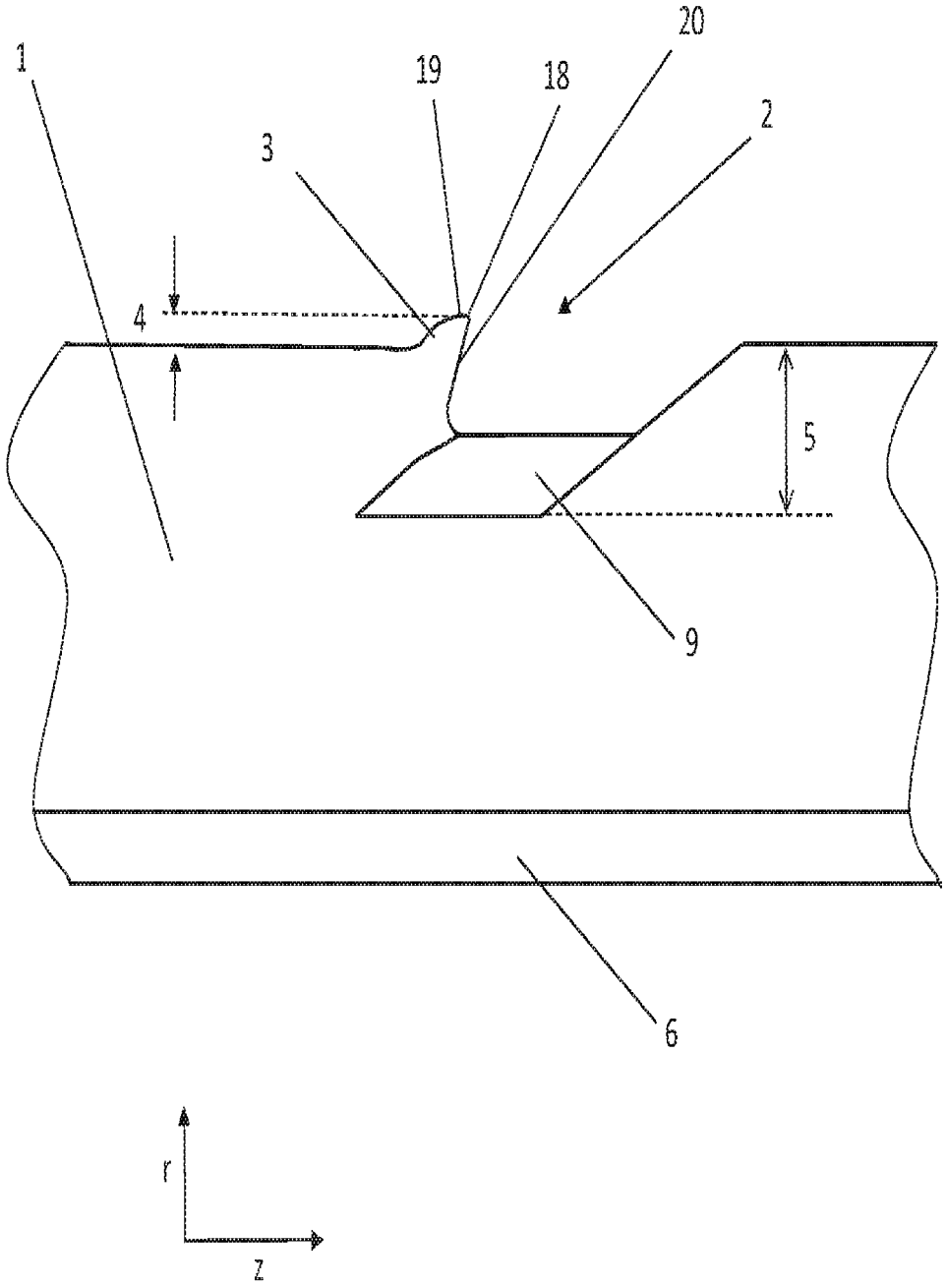
Fig. 1 Prior Art
FIG. 1 is a side view of part of a prior-art needle.

FIG. 1 is a side view of a prior-art felting needle 1 with a barb 2 and a barbing bead 3 generated by the barbing action. The barb 2 has a barb depth 5. The lower delimitation of the barb 2 is the barb base 9. Also of importance is the barb front 20, which ends, with increasing height (in the radial direction), in the inflection point 18 of the barb front. The influence of the barb bead is often quantified with the help of the barb projection 4 (=radial distance between the maximum height 19 of the barbing bead 3 and the inflection point 18 of the barb front).

Figure 3:
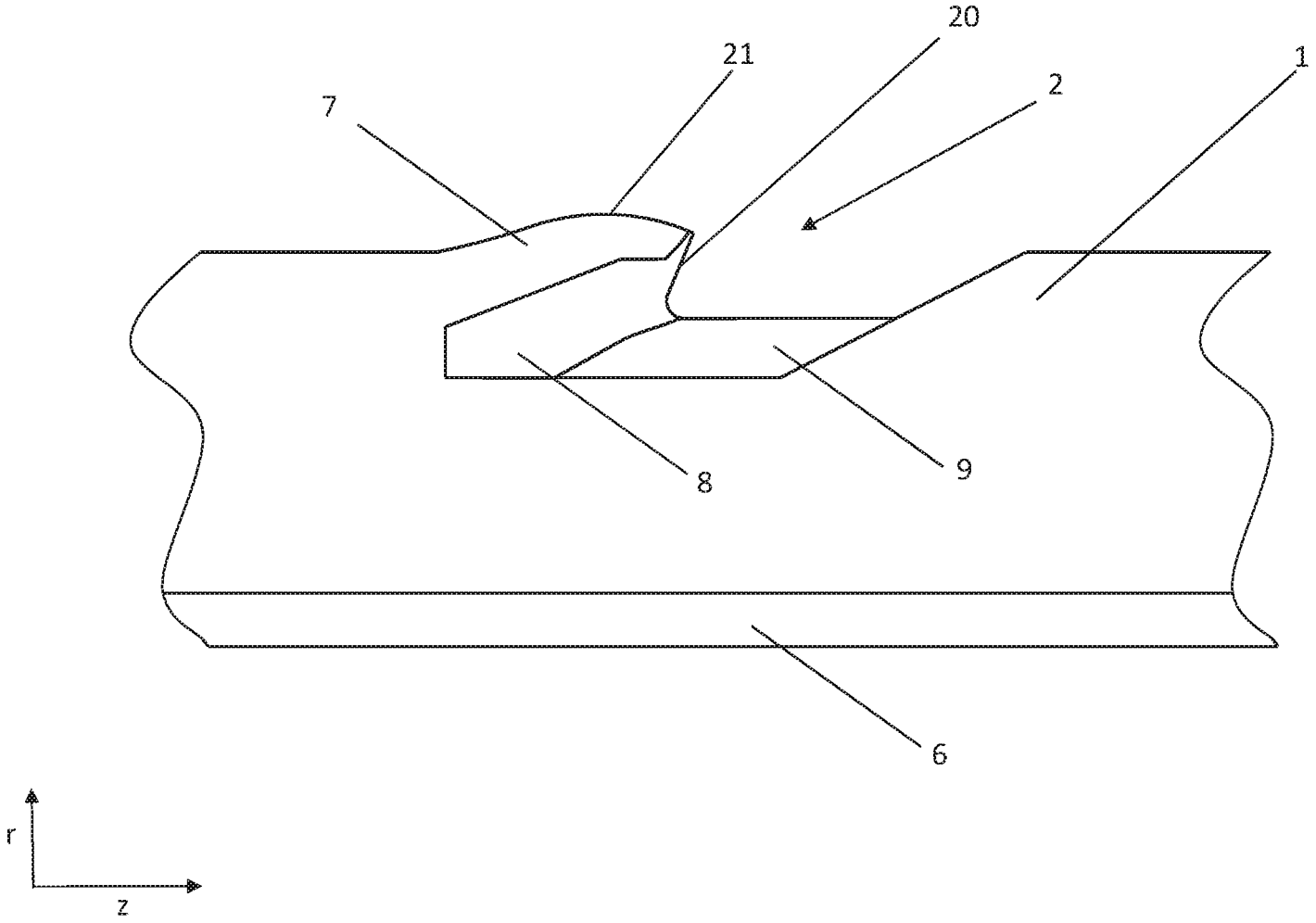
FIG. 3 is a side view of part of a needle 1 with a bulge 7 and a barb 2.
Figure 4:
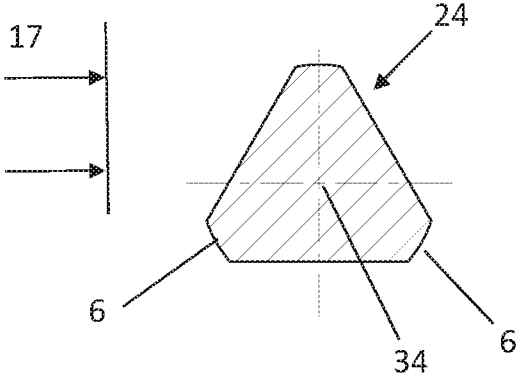
FIG. 4 is a side view of the cross section of the working part of a so-called standard triangular needle.

The needle 1 shown in FIG. 1 has a standard triangular cross-sectional shape 24, as shown in FIG. 4. The felting needles 1 shown in FIGS. 2 and 3 also have this cross-sectional shape 24. The edge 6 (edges of this kind are often termed bevel) is therefore also recognizable from the viewing plane 17 (see FIG. 4).

Figure 2:
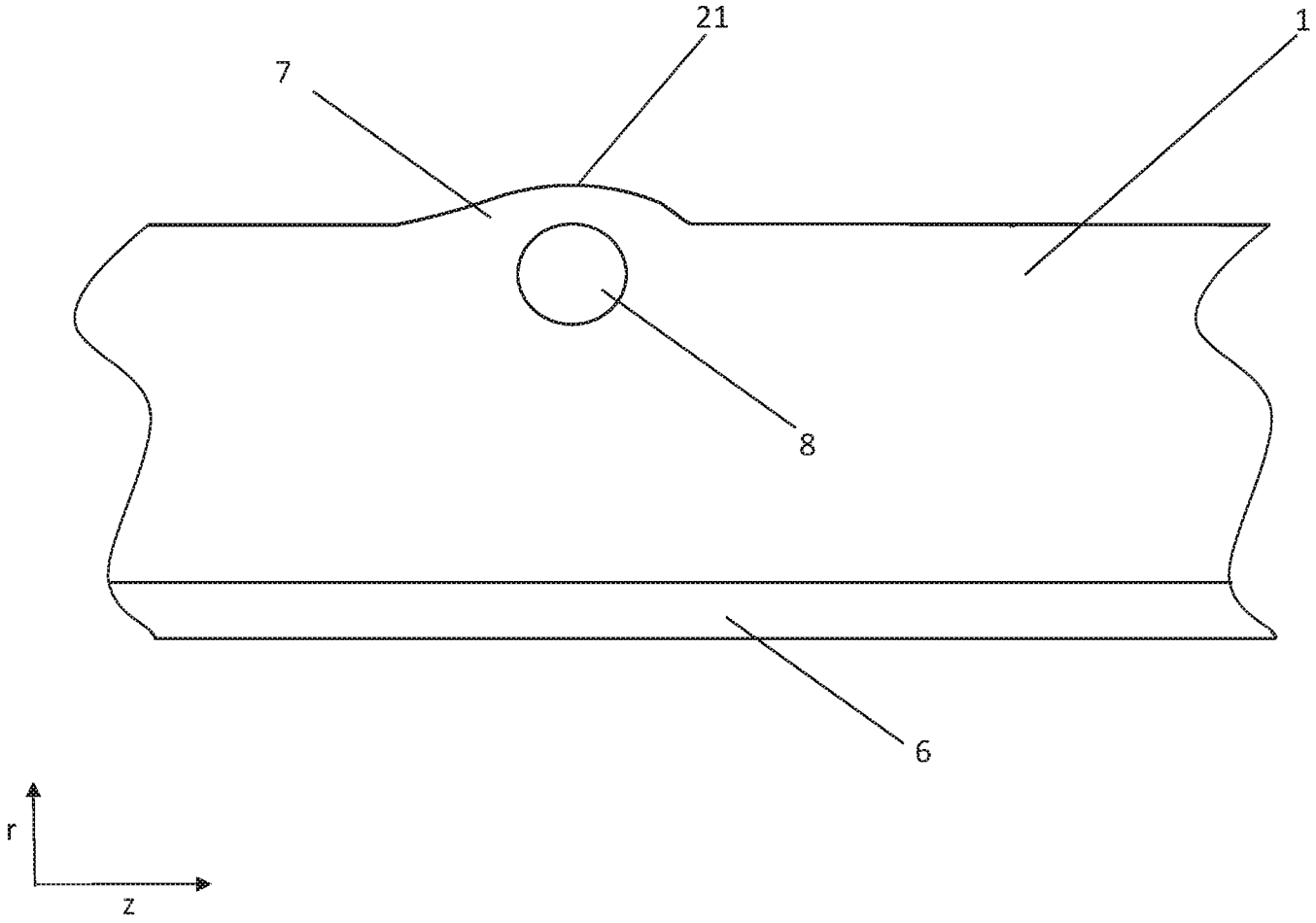
FIG. 2 is a side view of part of a needle which has already been provided with a bulge 7.

In addition to the aforementioned features, FIG. 2 also shows the bulge 7 with its maximum height 21. As already mentioned, a bulge of this kind may be produced in various ways. In the embodiment according to FIG. 2, the die imprint 8 is visible, indicating that the bulge 7 shown there has been created by means of a stamping process. No barb 2 is shown in FIG. 2.

FIG. 3, finally, is a side view of a felting needle 1, which, in addition to the bulge, also has a barb 2. Here too, therefore, a barb base 9 and a barb front 20 are visible. The geometry of the barb 2 and the bulge 7 shown in FIG. 3 may be created by means of an incut which penetrates into the surface of the already existent bulge 7.

FIGS. 4 to 9 exemplify various cross-sectional shapes 24-29 of the working parts 15 of felting needles. These cross-sectional shapes or areas extend in the plane defined by the radial direction (r) and the circumferential direction ((p) of the respective felting needle 1. These working parts 15 offer advantages, but use of this invention can also be extended to other cross-sectional shapes.

Figure 5:
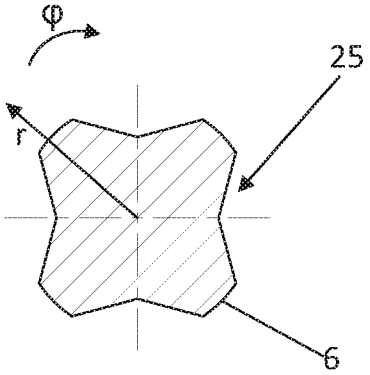
FIG. 5 is a side view of the cross section of the working part of a so-called Cross STAR needle.
Figure 6:
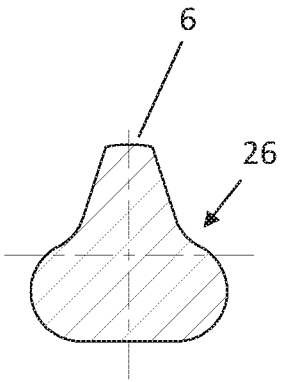
FIG. 6 is a side view of the cross section of the working part of a so-called teardrop needle.
Figure 7:
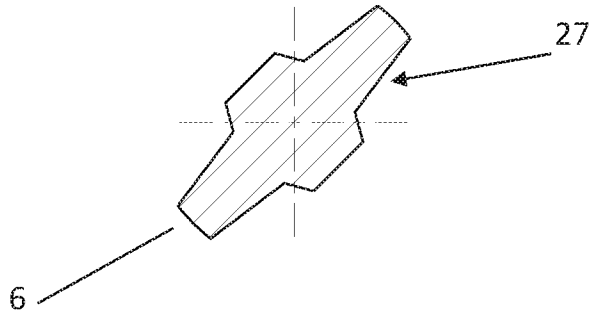
FIG. 7 is a side view of the cross section of the working part of a so-called Pinch Blade needle.
Figure 8:
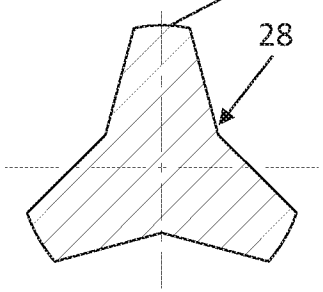
FIG. 8 is a side view of the cross section of the working part of a so-called Tri STAR needle.
Figure 9:
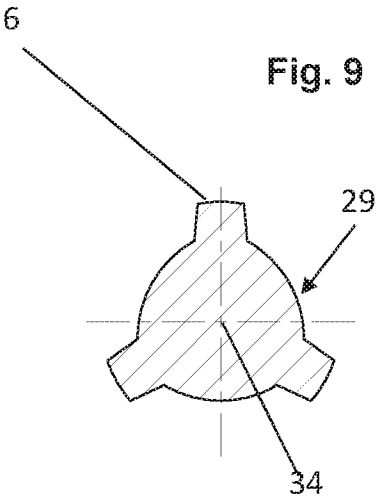
FIG. 9 is a side view of the cross section of the working part of a so-called EcoStar needle.

FIG. 4 shows a standard triangular cross-sectional shape 24 of a working part 15, which has three edges 6. The viewing plane 17 of FIGS. 1-3, 11-12 and 16-17 has already been mentioned. FIG. 5 shows the cross-sectional shape of a working part 15, said cross-sectional shape often being marketed under the brand name Cross STAR 25 and having four edges 6. The cross-sectional shape 26 in FIG. 6 is often called a teardrop by experts. The cross-sectional shape 27 shown in FIG. 7 is often termed Pinch Blade by experts. FIGS. 8 and 9 show cross-sectional shapes called Tri STAR 28 and EcoStar 29. What all the cross-sectional shapes mentioned have in common is that, in the needle's working part 15, they extend in the radial direction (r) and circumferential direction ((p) and form the cross-sectional shape of the working part for much of the length thereof. Exceptions in this respect are often made only by the barbs 2, the barbing beads 3 and the bulges 7. The cross-sectional shapes listed in the present publication are examples. The present invention is suitable for advantageously refining all the known and future cross-sectional shapes. The same applies with respect to different barb shapes.

Figure 10:
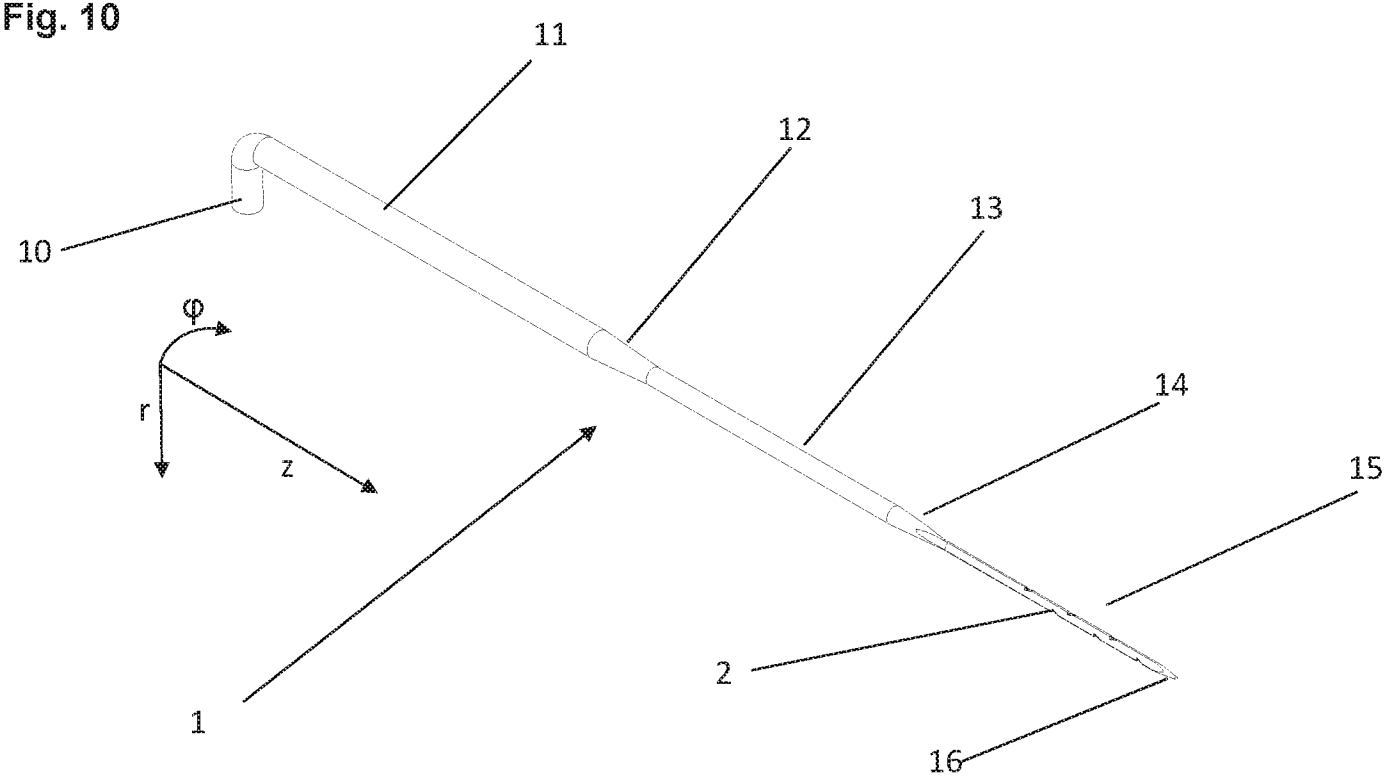
FIG. 10 is a perspective view of a felting needle 1.

FIG. 10 shows a felting needle 1 and clarifies some of the terms used in this publication. Like many felting needles, this needle 1 has a foot 10 for securing it to a needle board. After a 90° bend, the shank 11 of the felting needle commences, transitioning after the upper cone 12 into a reduced shank 13. It goes without saying that felting needles are known that only have one shaft, which is of uniform diameter, and not one shaft 11 and a reduced shaft 12. The lower cone 14 forms the transition to the working part 15, on which barbs 2 are visible. The felting needle 1 ends in a point 16. Of course, structuring needles, too, are known, where the shape of this "point" 16 or working-end extremity differs from those of typical needles. The present invention can be used to advantage with all kinds of felting needle.

Figure 11:
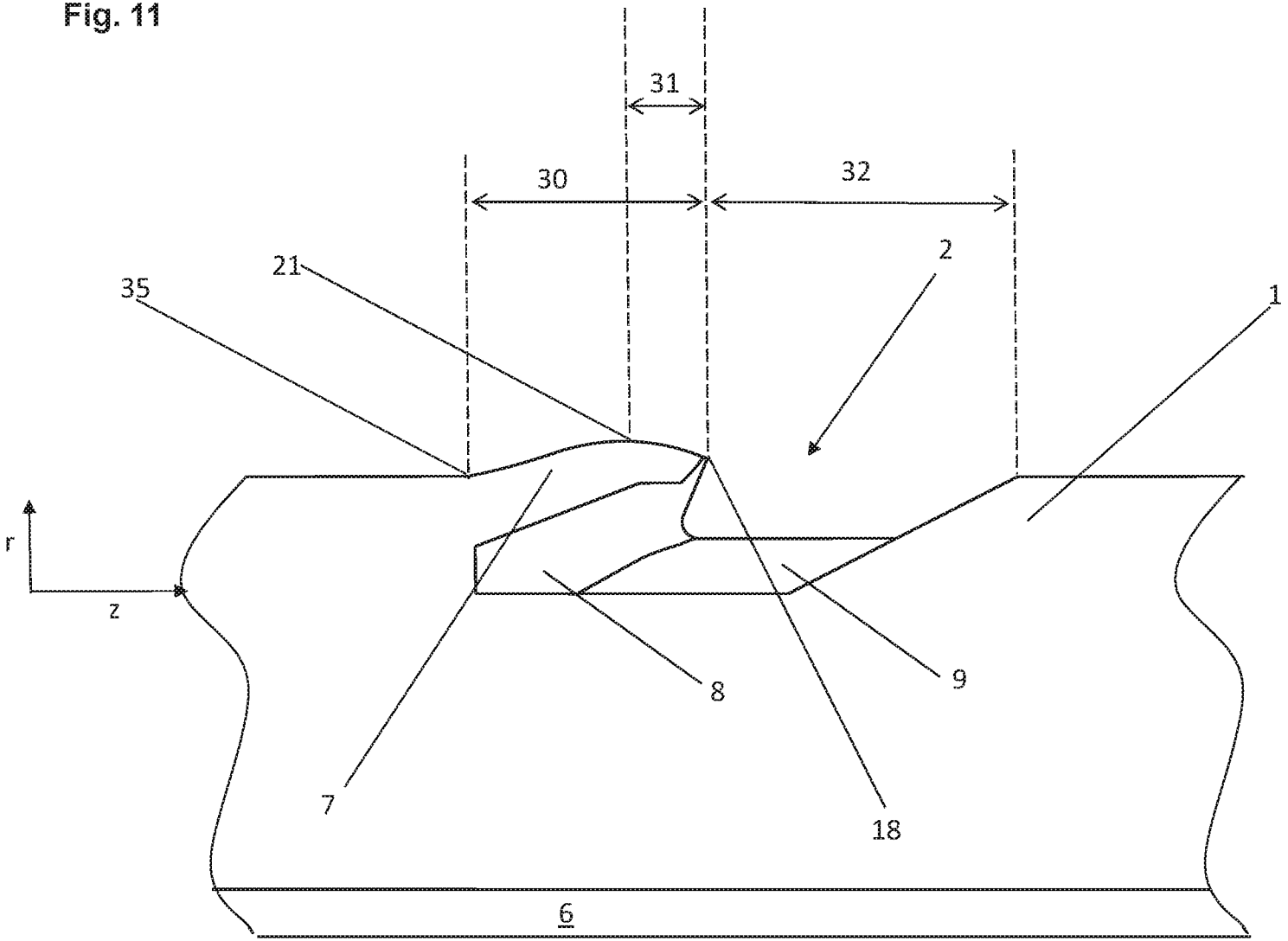
FIG. 11 shows a detail from FIG. 3.

FIG. 11 shows an enlarged detail from FIG. 3. This drawing serves to explain, in particular, the distances 30, 31 and 32:

- the longitudinal extent 30 of the bulge 7 in the z direction, which goes from the beginning 35 of the bulge to the inflection point 18 of the barb front 20;
- the distance 31 in the longitudinal direction (z) between the height maximum 21 of the bulge 7 and the inflection point 18 of the barb front;
- the longitudinal extent 32 of the barb opening/the length 32 of the barb opening in the longitudinal direction (z) of the needle 1.

Figure 12:
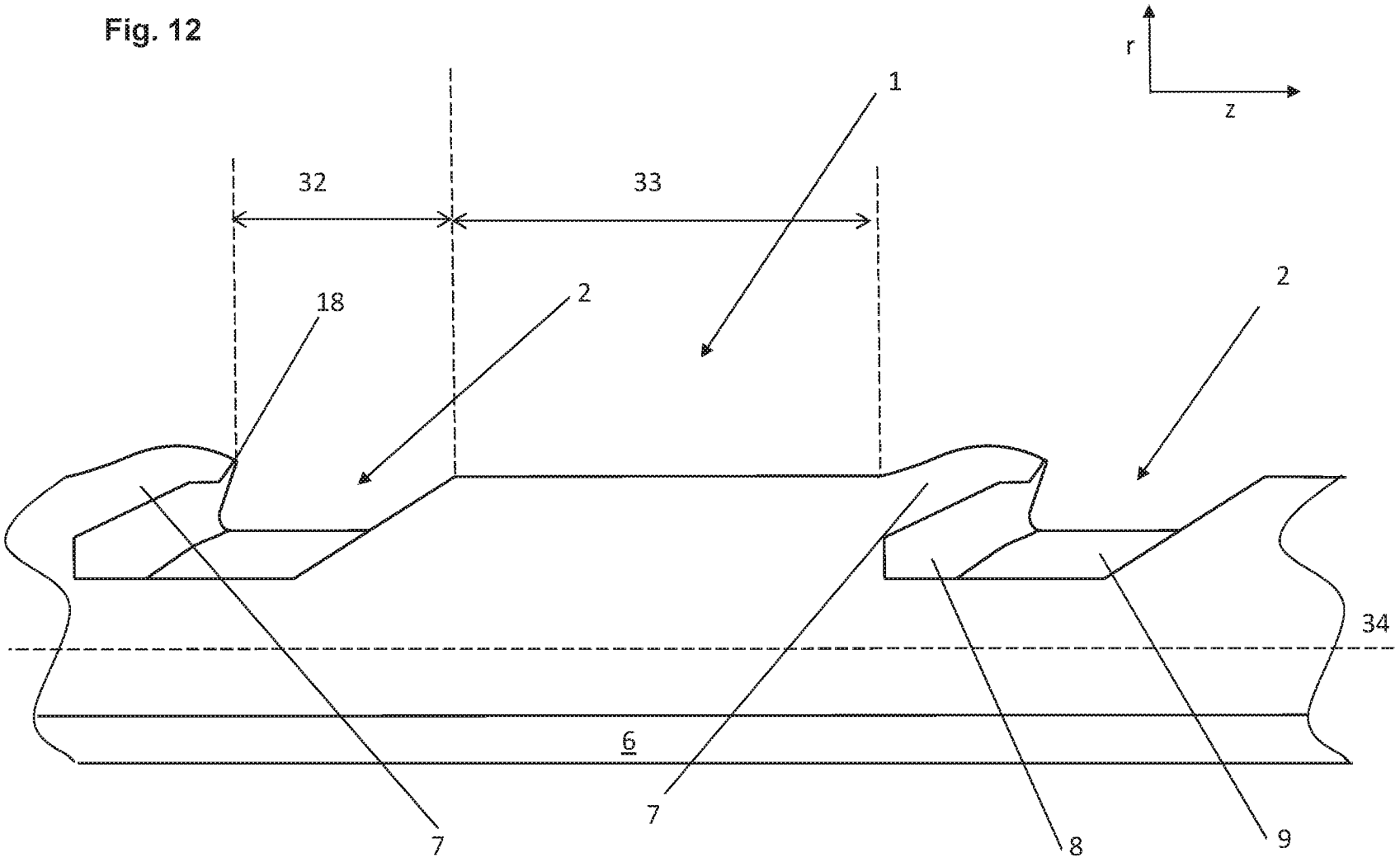
FIG. 12 shows part of a needle and serves to clarify further terms.

FIG. 12 shows a longer section of the needle 1 shown in FIGS. 3 and 11 from the same viewing plane 17. In FIG. 12, two barbs 2 and two bulges 7 are visible. The aforementioned objects have the same position in the circumferential direction (cp). The length 32 of the barb opening in the longitudinal direction (z) of the needle 1 and the distance 33 from the lip of the barb opening to the beginning of the next bulge 7 are also shown. As already mentioned, it is advantageous if these two lengths or distances 32, 33 have a given ratio one to the other and if a given minimum distance 33 is observed.

FIGS. 13-15 again show cross-sectional areas 27-29 of working parts of felting needles 1, which extend along the plane defined by the radial direction (r) and the circumferential direction ((p) of the needles. It is to advantage, but by no means essential, if the bulge 7 lies on an edge 6. There are a number of advantageous ways of creating such a bulge. Examples:

During shaping of the cross-sectional area 24-29 of the working part 15.

Figure 13:
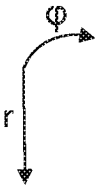
FIG. 13 again shows a cross-sectional area of a working part of a needle.
Figure 13:
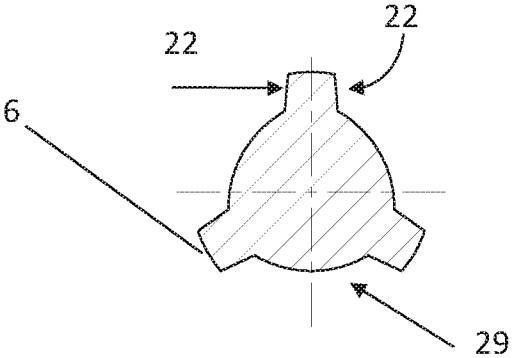

By means of a stamping process, as is symbolized in FIG. 13 by the arrow 22. Two or one stamping die(s) or tool(s) may be moved in this process.

Figure 15:
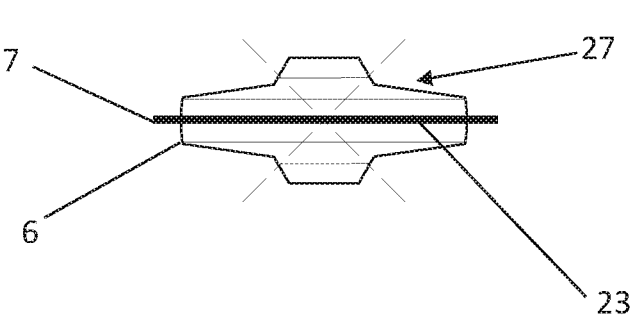
FIG. 15 again shows a further cross-sectional area of a working part of a needle having a bulge made of a foreign material.
Figure 14:
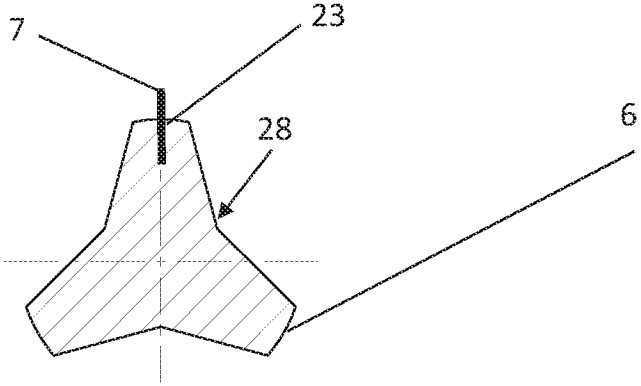
FIG. 14 again shows a cross-sectional area of a working part of a needle having a bulge made of a foreign material.

By means of inserting foreign material 23, as shown in FIG. 14. If the intention is to locate the bulge on an edge, and if the cross-sectional shape 24-29 of the working part has edges 6 that are offset relative to one another by approx. 180° in the circumferential direction, as is the case with the cross-sectional shape 27, it is even possible to pierce the needle with such a body of foreign material 23 and push it through the needle; alternatively, the body of foreign material can be pushed through an appropriate hole created by drilling or a similar process (FIG. 15).

In FIG. 12, a broken line indicates the location of the needle axis 34 within the needle. FIGS. 6 and 8 indicate this needle axis explicitly with the reference numeral 34. This position is indicated by means of a cross in the other drawings, too, which show cross-sectional surfaces of needles 1. The needle axis 34 is the centre of the part of the needle (in FIG. 10 shank 11, upper cone 12, reduced shank 13, lower cone 14, working part 14 and maybe point 15) running lengthwise of the needle. One might also say that the needle axis 34 is the needle's principal symmetry axis without the foot 10.

Figure 16:
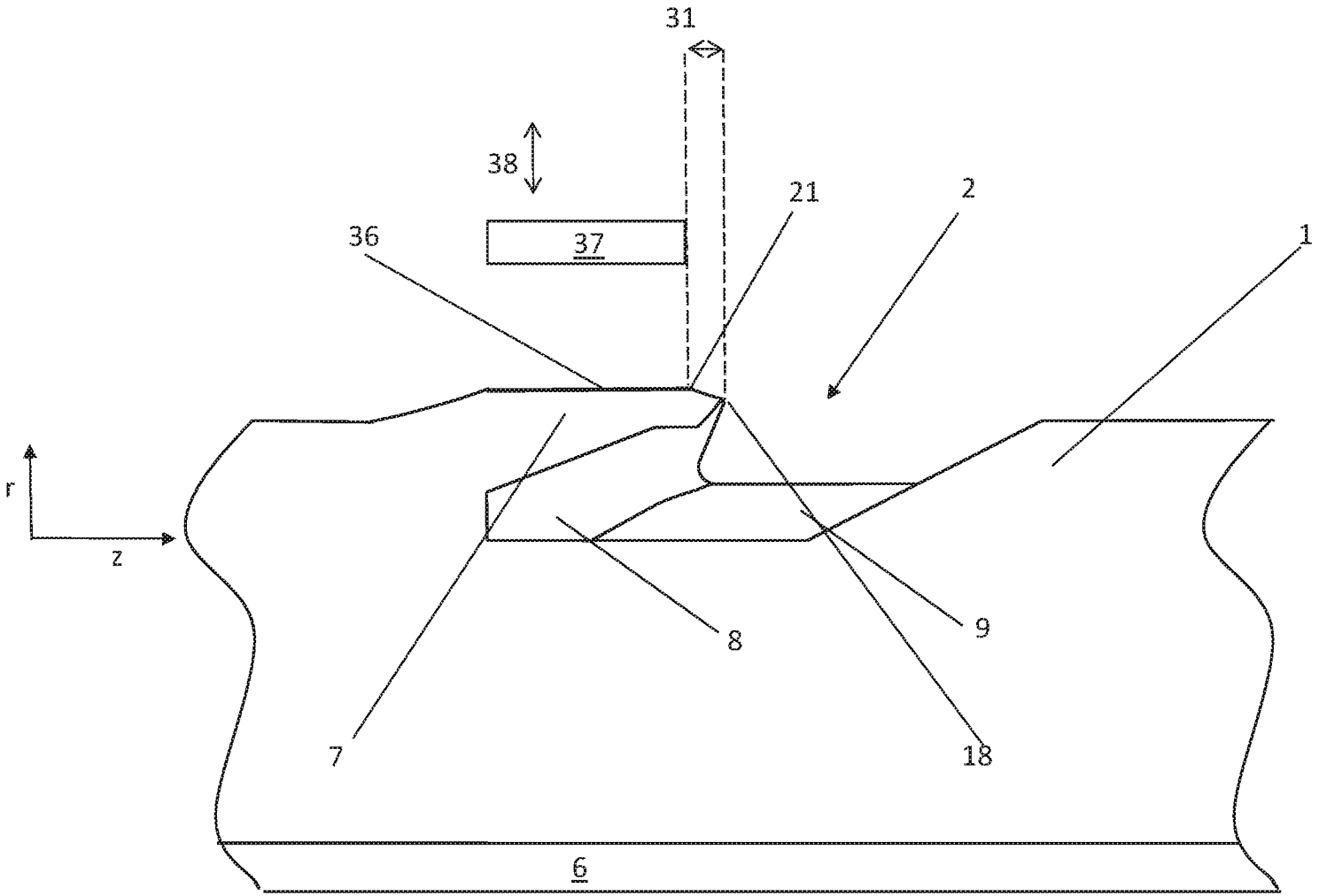
FIG. 16 is a side view of part of a needle 1 having a further embodiment of a bulge 7.
Figure 17:
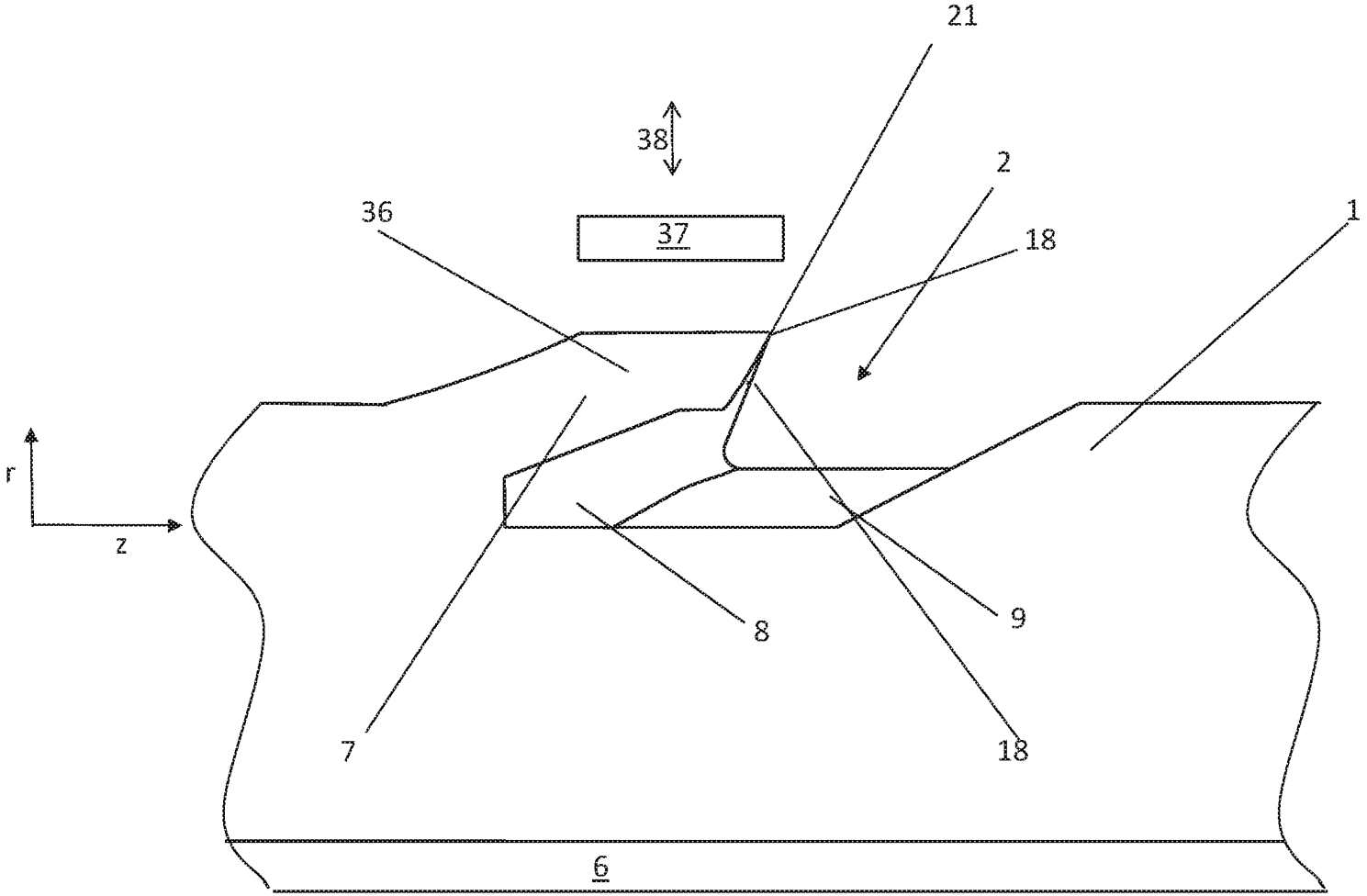
FIG. 17 is a side view of part of a needle 1 having a further embodiment of a bulge 7.

FIGS. 16 and 17 show side views of a part of two needles 1 with further embodiments of bulges 7, which are provided, in the radial direction (r), with a specially formed bounding surface 36 of the bulge 7. This shaping of the bounding surface 36 may be performed with a radially acting die 37. The double-headed arrow 38 shows the direction of action of this die. In this context, direction of action does not necessarily mean that the die 37 is also moved in this direction (r). It 37 can, for example, also act in this direction if it is stationary relative to the needle 1 and counters further growth of the bulge 7 during creation of the latter. The described forming process for the bounding surface 36 is advantageous for all embodiments of the needle shown. It enables the height of the bulge, that is, the radial distance from the needle axis 34 to the bounding surface 36, to be set exactly. It is, of course, also possible to set the position of the bounding surface 36 in the other spatial directions. This is emphasized by the difference between the embodiments shown in FIGS. 16 and 17: in the embodiment according to FIG. 16, there is a distance 31 between the height maximum 21 of the bulge 7 and the inflection point 18 of the barb front. The bounding surface 36 begins when the bulge has reached its maximum height 21.

In the embodiment according to FIG. 17, the distance 31 has shrunk to "zero". This result may be obtained by positioning the radially acting die 37 differently relative to the needle 1 in the longitudinal direction (z) thereof during forming of the bounding surface 36 (cf. FIG. 17 again).

This example, too, makes it clear that a very large number of felting needle variants can be produced using the described method.

| List of reference numerals | |
|---|---|
| 1 | Felting needle |
| 2 | Barb |
| 3 | Barbing bead |
| 4 | Barb projection |
| 5 | Barb depth |
| 6 | Edge |
| 7 | Bulge |
| 8 | Die imprint |
| 9 | Barb base |
| 10 | Foot of the felting needle |
| 11 | Shank of the felting needle |
| 12 | Upper cone |
| 13 | Reduced shank of the felting needle |
| 14 | Lower cone |
| 15 | Working part |
| 16 | Needle point |
| 17 | Viewing plane |
| 18 | Inflection point of the barb front |
| 19 | Maximum height of the barbing bead |
| 20 | Barb front |
| 21 | Maximum height of the bulge |
| 22 | Arrow showing movement of pinching die |
| 23 | Foreign material |
| 24 | Standard triangular |
| 25 | Cross STAR |
| 26 | Teardrop |
| 27 | Pinch Blade |
| 28 | Tri STAR |
| 29 | EcoStar |
| 30 | Longitudinal extent (z) of the bulge 7 |
| 31 | Distance, in the longitudinal direction, between the height maximum 21 of the bulge and the inflection point 18 of the barb front |
| 32 | Longitudinal extent (z) of the barb opening 2/Length of the barb opening in the longitudinal direction of the needle 1 |
| 33 | Distance, in the longitudinal direction, between the opening of a first barb 3 and a further bulge 7 |
| 34 | Needle axis, symmetry axis of the needle without its foot |
| 35 | Start of the bulge (here, at the end further from the barb, the bulge begins to rise above the circumferential surface of the working part's cross-sectional profile) |
| 36 | Bounding surface of the bulge in the radial direction |
| 37 | Radially acting die |
| 38 | Arrow showing direction of action of the die |
| z | Longitudinal coordinate of the needle |
| r | Radial coordinate of the needle |
| φ | Circumferential coordinate of the needle |

The invention claimed is:

1. A felting needle (1) which extends lengthwise (z) from a mounting (10) to a working-end extremity (16) thereof and which has a working part (15) that extends lengthwise (z) along a part of a longitudinal extent (z) of the felting needle (1), the felting needle comprising:

a cross-sectional area (24-29) which extends in radial (r) and circumferential directions (φ) of the felting needle (1) and forms the cross-sectional area (24-29) of the working part (15) for a majority of the length thereof, at least one barb (2), which penetrates into the working part (15) and is formed by an incut running from an outer surface of the working part (15) towards an interior of the felting needle (1), wherein the at least one barb includes a lip at which a height of the barb in the radial direction is at its maximum;

at least one bulge (7), proximal to the barb lip, that projects convexly beyond a circumferential surface of the felting needle (1) in the working part thereof (15) in the needle's radial direction (r) and has a maximum height in the radial direction that is greater than the height of the lip, wherein the at least one bulge (7) extends lengthwise (z) along the felting needle (1) only along a part of the working part (15) in said lengthwise direction (z), wherein the at least one bulge (7) includes a barbing bead portion formed as a result of the formation of the at least one barb, wherein the at least one barb (2) adjoins the at least one bulge in the lengthwise direction (z) of the felting needle (1), and wherein the needle further comprises an elongate die imprint resulting from formation of the at least one bulge adjacent to the at least one bulge that extends in the lengthwise direction.

2. The felting needle according to claim 1, wherein a height (H) measured from a needle axis (34) in the radial direction (r) of the at least one bulge (7) varies along an extent (30) of the bulge (7) lengthwise (z) along the felting needle (1).

3. The felting needle according to claim 1, wherein the maximum height of the at least one bulge along a longitudinal extent (30) of the at least one bulge (7) lengthwise (z) along the felting needle (1) is spaced lengthwise (z) along the needle (1) from the lip (18) of the at least one barb (2) by at least 25% of the entire longitudinal extent (30) of the at least one bulge (7).

4. The felting needle according to claim 1, wherein a width of the at least one bulge (7) in the circumferential direction (φ) of the needle tapers as a height (H) of the at least one bulge increases in radial direction (r).

5. The felting needle according to claim 1, wherein the at least one bulge (7) is a swaged bulge.

6. The felting needle according to claim 1, wherein, on a side of the at least one bulge (7) on which the at least one barb (2) adjoins the outer surface of the at least one bulge (7), at least for a distance (33) corresponding to a length (32) of the barb opening lengthwise (z) along the felting needle (1), no further bulge (7) that overlaps in the circumferential direction (φ) with the at least one barb (2) is located lengthwise (z) along the felting needle (1).

7. A method of producing at least one felting needle (1) which extends lengthwise (z) from a mounting (10) to a working-end extremity (16) thereof, the method comprising:

providing a felting needle blank;

shaping a working part (15) having a cross-sectional area (24-29) that extends in radial (r) and circumferential directions (φ) of the felting needle (1) and forms the cross-sectional area (24-29) of the working part (15) for a majority of a lengthwise (z) extent thereof (15), striking a barb (2), which penetrates into the working part (15) and is formed by an incut (2) running from an outer surface of the working part (15) towards an interior of the felting needle (1), wherein the barb includes a lip at which a height of the barb in the radial direction is at its maximum;

forming at least one bulge (7) which projects convexly in the needle's radial direction (r) beyond a circumferential surface of the felting needle (1) in the working part (15) thereof and which (7) extends only over a part of the extent of the working part (15) lengthwise (z) along the at least one felting needle (1), and selecting the position of the barb (2) and the at least one bulge (7) such that the barb (2) adjoins an outer surface of the at least one bulge (7) lengthwise (z) along the needle (1) and the at least one bulge has a maximum height in the radial direction that is greater than the height of the lip;

wherein the step of forming at least one bulge and the step of striking the barb are performed separately using different tools.

8. The method according to claim 7, wherein the at least one bulge (7) is formed before the striking of the barb (2).

9. The method according to claim 8, wherein during the striking of the barb (2), a barbing tool also displaces some of the at least one bulge (7).

10. The method according to claim 7, wherein the working part (15) is formed such that it has at least one corner or edge (6) that extends over a majority of the length of the working part (15), and the at least one bulge (7) is formed on a part of a longitudinal extent (z) of the at least one corner or edge (6).

11. The method according to claim 7, wherein forming of the at least one bulge (7) is effected using at least two pressing tools which act in opposite directions at least predominantly in the radial direction (r) of the needle (1).

12. The method according to claim 7, further comprising forming a bounding surface (36) of the at least one bulge (7), which delimits the at least one bulge (7) at least predominantly in the radial direction (r) of the needle (1), by at least one die (27) acting predominantly in the radial direction (r) of the needle (1).

13. The method according to claim 12, further comprising moving the at least one radially (r) acting die (27) in the radial direction (r) of the needle (1) during or after forming of the bulge (7), or causing the die (27) acting in the radial direction (r) of the needle (1) to perform no movement relative to the needle in the radial direction thereof during forming of the bulge (7) such that the die serves as a stop for the material of the bulge, thereby forming the bounding surface (36) of the bulge (7).

14. The method according to claim 7, further comprising using at least one radially (r) acting die (27) to form the bulge (7), said die having a work surface acting at least predominantly in the circumferential direction (φ).

* * * * *